US008042316B2

(12) United States Patent
Lee et al.

(10) Patent No.: US 8,042,316 B2
(45) Date of Patent: Oct. 25, 2011

(54) FIREPROOF DOOR

(75) Inventors: Won-Ho Lee, Gyeonggi-do (KR); Sang-Ho Shin, Chungcheongbuk-do (KR); Seong-Hoon Yue, Gyeonggi-do (KR)

(73) Assignee: LG Chem, Ltd. (KR)

( * ) Notice: Subject to any disclaimer, the term of this patent is extended or adjusted under 35 U.S.C. 154(b) by 266 days.

(21) Appl. No.: 12/321,131

(22) Filed: Jan. 15, 2009

(65) Prior Publication Data

US 2010/0175322 A1 Jul. 15, 2010

(51) Int. Cl.
*E04C 2/02* (2006.01)

(52) U.S. Cl. ..... 52/784.11; 52/204.71; 52/455; 52/800.14

(58) Field of Classification Search ..... 52/656.4, 52/656.2, 784.11, 784.1, 800.12, 800.13, 52/800.14, 455, 204.7, 204.71
See application file for complete search history.

(56) References Cited

U.S. PATENT DOCUMENTS

| | | | | |
|---|---|---|---|---|
| 1,049,429 | A * | 1/1913 | Wheeler | 52/784.11 |
| 1,126,794 | A * | 2/1915 | Lee | 52/784.11 |
| 1,769,757 | A * | 7/1930 | Irving | 52/784.11 |
| 4,281,493 | A * | 8/1981 | Pitt | 52/309.11 |
| 4,637,182 | A * | 1/1987 | Ellsworth et al. | 52/211 |
| 4,852,312 | A * | 8/1989 | Harbom | 52/126.3 |
| 5,135,788 | A * | 8/1992 | Nolte | 428/38 |
| 6,289,641 | B1 * | 9/2001 | McCandless | 52/172 |
| 6,606,831 | B2 * | 8/2003 | Degelsegger | 52/204.1 |
| 6,668,499 | B2 * | 12/2003 | Degelsegger | 52/204.62 |
| 7,730,677 | B2 * | 6/2010 | Hansen | 52/204.5 |
| 7,921,614 | B2 * | 4/2011 | Fortin et al. | 52/204.71 |
| 2001/0017019 | A1 * | 8/2001 | Degelsegger | 52/783.1 |
| 2006/0070318 | A1 * | 4/2006 | Chen et al. | 52/204.65 |
| 2009/0113826 | A1 * | 5/2009 | Abdul Lathief | 52/214 |
| 2009/0211190 | A1 * | 8/2009 | Honey | 52/309.3 |
| 2010/0266800 | A1 * | 10/2010 | Dutsch et al. | 428/40.4 |
| 2011/0005149 | A1 * | 1/2011 | Chen | 52/173.1 |

FOREIGN PATENT DOCUMENTS

GB 2190125 A * 11/1987

* cited by examiner

*Primary Examiner* — Brian Glessner
*Assistant Examiner* — Rodney Mintz
(74) *Attorney, Agent, or Firm* — Lerner, David, Littenberg, Krumholz & Mentlik, LLP

(57) ABSTRACT

The present invention relates to a fireproof door, which comprises a fire-protection glass and a support means for supporting the fire-protection glass, and the support means comprising an elastic member in contact with both surfaces of an edge portion of the fire-protection glass, a reinforcing frame for supporting the elastic member, and a fixing plate fixed to a support and corresponding to both surfaces of the reinforcing frame. The fireproof door of the present invention has a grade A fireproof performance.

7 Claims, 5 Drawing Sheets

FIG. 5/5
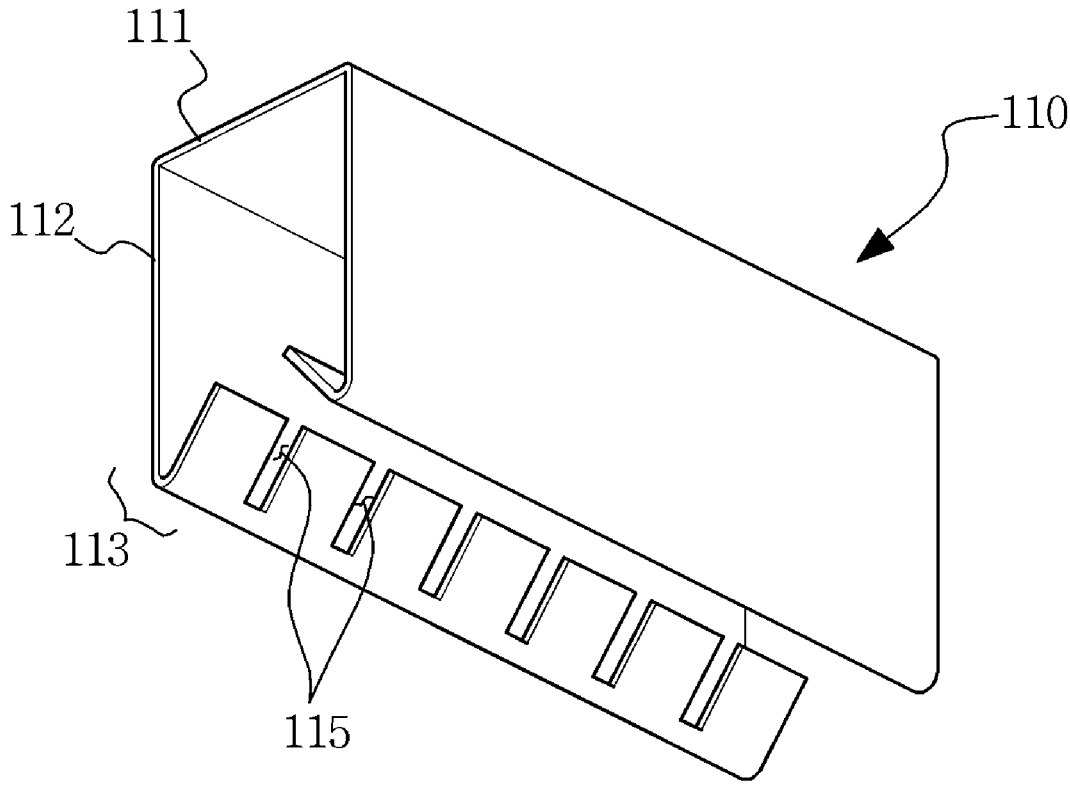

FIREPROOF DOOR

BACKGROUND OF THE INVENTION

1. Field of the Invention

The present invention relates to a fireproof door, and more particularly, to a fireproof door having a grade A fireproof performance.

2. Description of the Related Art

In general, a fireproof door means a door having an ability to endure a fire. The fireproof door serves to gain time for persons to escape from a fire, prevent the spread of a fire, delay a fire propagation, and endure fire over a certain time. The fireproof doors are classified into grade according to the performance of fire resistance.

Here, the grade A fireproof performance of the fireproof door means that the performance of fire resistance can be ensured for 1 hour or more as a result of the tests according to the Korean Industrial Standards regulated in the Industrial Standardization Act.

Conventional fireproof doors with glass applied thereto, which have a fire-resistance for 1 hour or more, are mainly formed of steel, thereby being generally used as only a front door.

Such door can resist effectively the spread of fire if it is applied to a room door, but this door is not easily constructed as a room door due to the heterogeneity between the wooden indoor design and the steel door. In addition, due to cold sensation of steel itself, the conventional fireproof door is not harmonized with the interior design, thereby defiling a beauty of the interior design.

Due to such drawbacks, wooden fireproof doors with glass applied thereto are often commercialized in Europe. However, a fire-resistant glass without thermal deformation is employed in wooden fireproof doors to ensure fire resistance for 1 hour or more. In other cases, most fireproof doors just ensure fire resistance for less than 1 hour.

However, such a fire-resistant glass is expensive, which increases a burden on production costs, and there is also a limit in supply and demand. Thus, there is a practical problem in commercialization.

SUMMARY OF THE INVENTION

The present invention is conceived to solve the above-mentioned problems of the conventional fireproof door, an object of the present invention is to provide a fireproof door that may ensure a grade A fire-protection performance while being in harmonization with interior designs.

A fireproof door according to the present invention comprises a frame-shaped support having an opening formed thereon; a fire-protection glass placed in the opening of the support and supported to the support; and a support means fixed to the support for supporting the fire-protection glass to the support.

Here, the support means comprising an elastic member in contact with both surfaces of an edge portion of the fire-protection glass, fixing plates being fixed to the support and being in contact with both side surfaces of the elastic member through inner surfaces thereof to support the elastic member to the support, and a reinforcing frame provided between the fixing plate and the elastic member.

In particular, the elastic member is composed of a first portion corresponding to a terminal end of the fire-protection glass, second portions extending from both ends of the first portion and corresponding to both sides of the fire-protection glass, respectively, and third portions respectively bent from ends of the second portions toward the fire-protection glass, whereby the edge portion of the fire-protection glass is placed between the second portions of the elastic member and ends of the third portions of the elastic member are in contact with both side surfaces of the fire-protection glass.

Preferably, the elastic member may be divided into a plurality of unit elastic pieces, the unit elastic pieces are spaced from each other.

The fireproof door of the present invention may further comprise a nonflammable tape disposed between the reinforcing frame and the fixing plate and a flame retardant wood may be attached to an periphery of the fixing plate.

Also, the elastic member may have a plurality of slits in the bent third portion.

Preferably, the fixing plate is in contact with the fire-protection glass through an end portion bent toward the fire-protection glass.

In addition, the fireproof door of the present may further comprise an expansible flame retardant attached to a surface of the bent portion of the fixing plate. In particular, an expansible flame retardant may be received in a space formed between the reinforcing frame and the support and fixed to at least one of the fixing plate and the reinforcing frame through one surface thereof.

BRIEF DESCRIPTION OF THE DRAWINGS

FIG. 5 is an enlarged perspective view of the elastic member constituting a fireproof door according to one embodiment of the present invention.

DESCRIPTION OF THE PREFERRED EMBODIMENT

Hereinafter, a fireproof door according to one embodiment of the present invention will be described in more detail with reference to the accompanying drawings.

Figure 1:
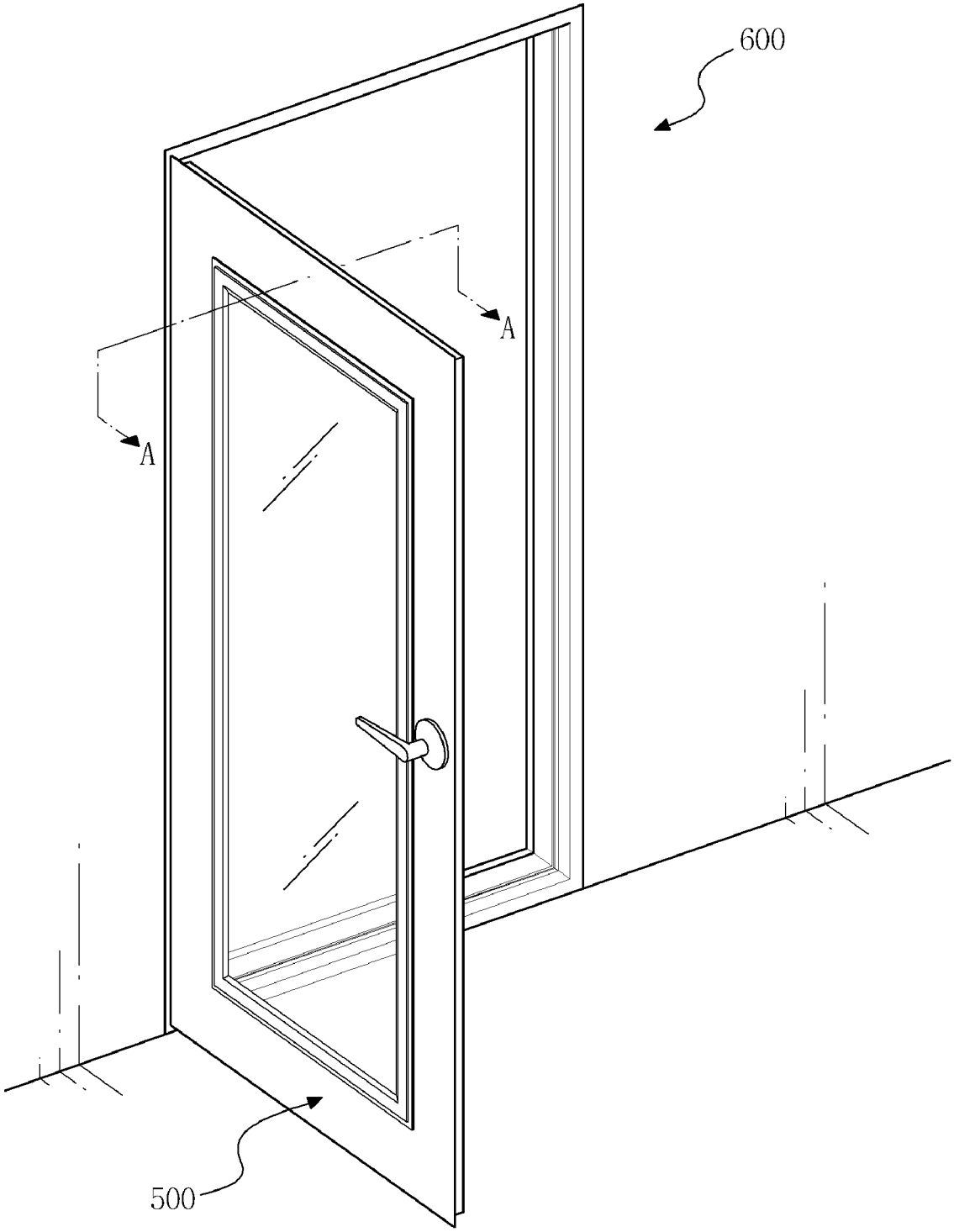
FIG. 1 is a perspective view of a fireproof door according to one embodiment of the present invention.
Figure 2:
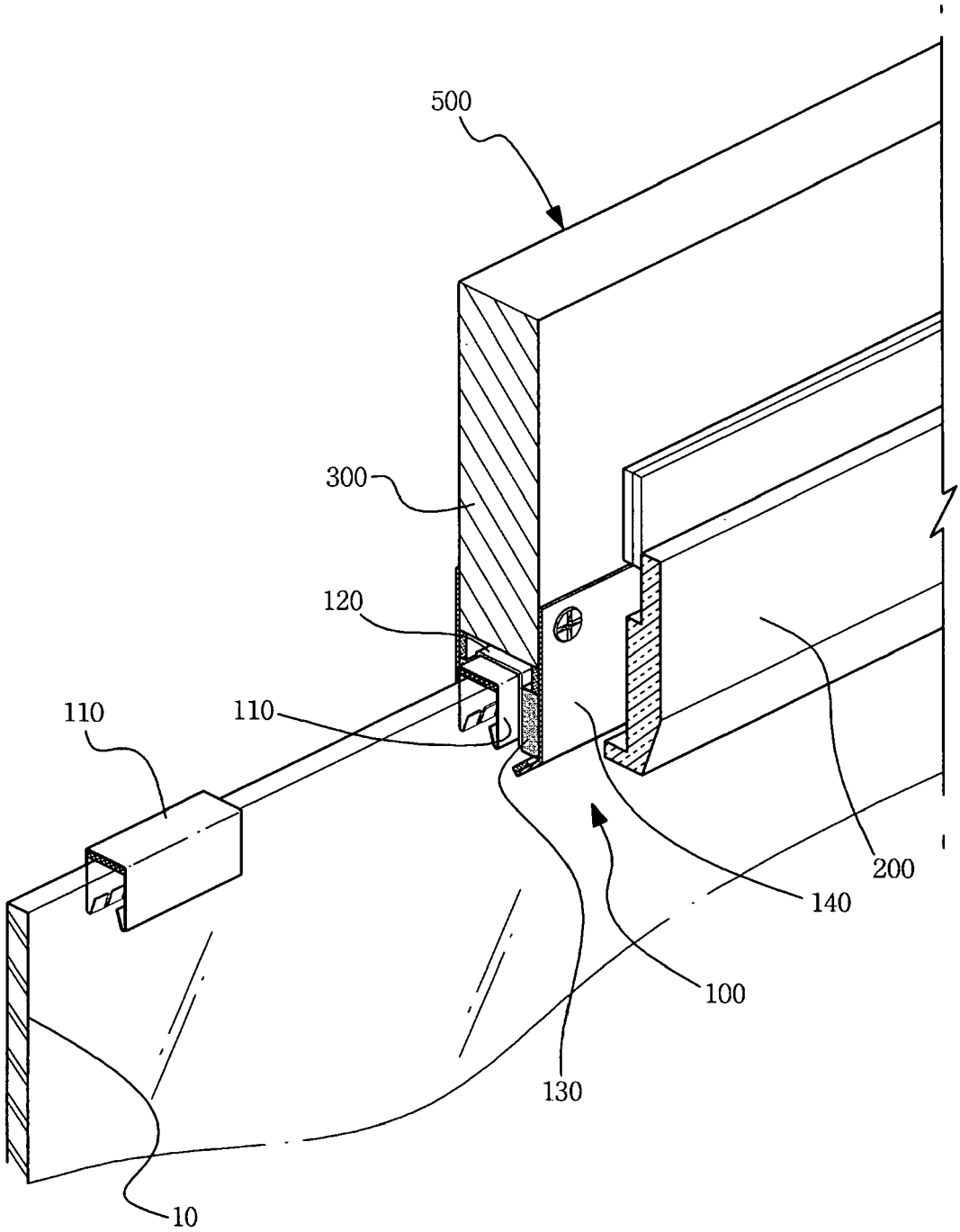
FIG. 2 is an enlarged perspective view taken along line A-A of FIG. 1.
Figure 3:
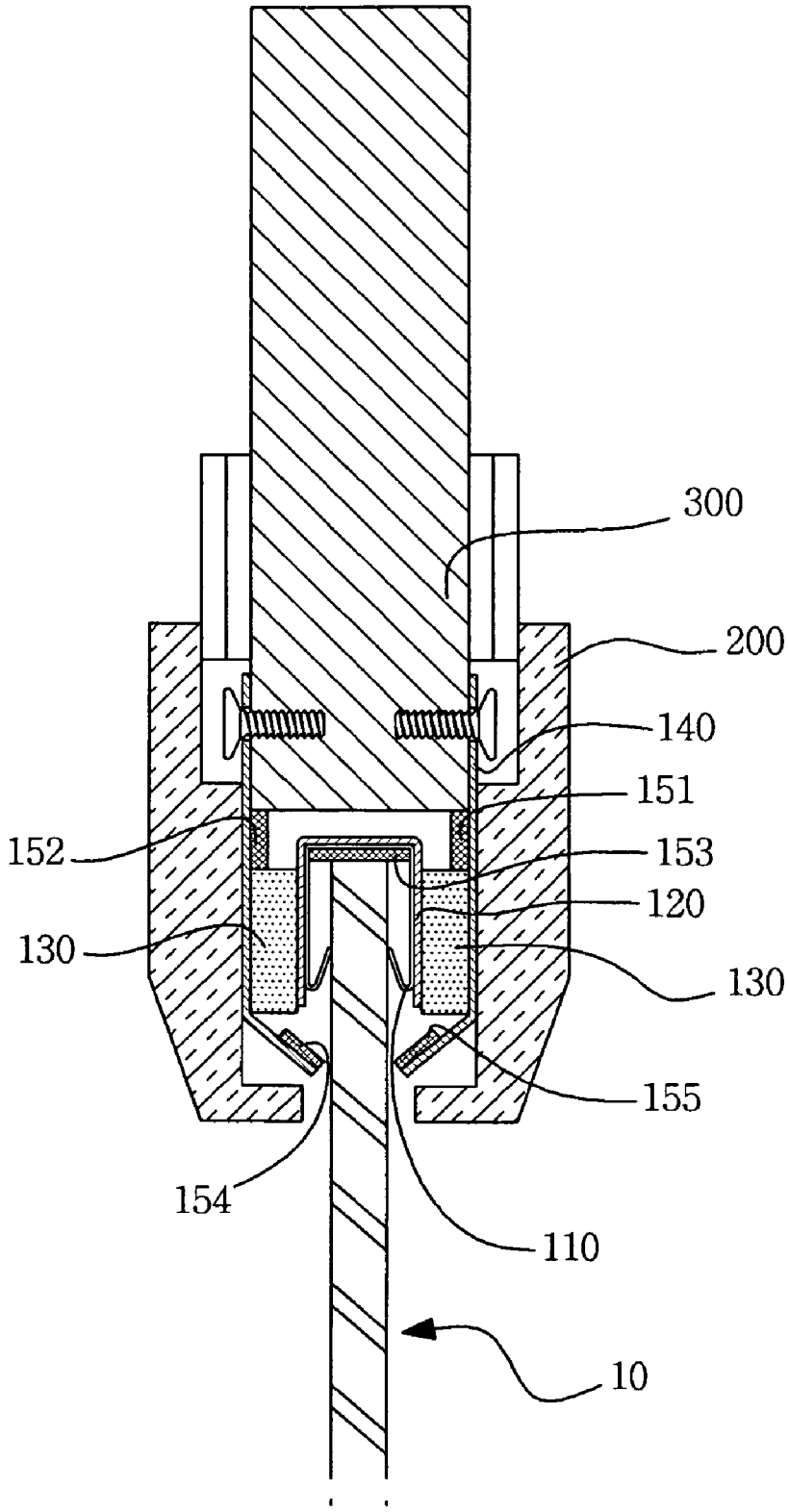
FIG. 3 is a detailed sectional view taken along line A-A of FIG. 1.

FIG. 1 is a perspective view showing an example of the fireproof door according to one embodiment of the present invention, FIG. 2 is an enlarged perspective view taken along line A-A of FIG. 1 and FIG. 3 is a detailed sectional view taken along line A-A of FIG. 1.

A fireproof door 500 according to the embodiment comprises a frame-shaped support 300 having an opening formed thereon, a fire-protection glass 10 placed in the opening of the support and supported to the support 300 and a supporting means 100 for supporting the fire-protection glass 10 to the support 300.

The support means 100 comprises an elastic member 110 which is in contact with both surfaces of an edge portion of the fire-protection glass 10, fixing plates 140 fixed to the support 300 and contacted to both side surfaces of the reinforcing frame 120 and a reinforcing frame 120 provided between the fixing plate 140 and the elastic member 110.

The elastic member 110 may be composed of a first portion 111 corresponding to an end portion of the fire-protection glass 10, second portions 112 extended from both ends of the first portion 111 and corresponding to both side surfaces of the fire-protection glass 10, respectively, and third portions 113 bent from ends of the second portions 112 toward the fire-protection glass 10, respectively.

In the above structure, the edge portion of the fire-protection glass 10 is placed between the second portions 112 of the elastic member 110 and ends of the third portions 113 of the elastic member 110 are in contact with both side surfaces of the fire-protection glass 10.

The elastic member 110 elastically supports the fire-protection glass 10 so as to prevent the fire-protection glass 10 from being separated from the support 100 when the fire-protection glass 10 is moved freely and deformed at the time of the fire.

Also, the elastic member 110 is preferably formed such that, in a case where the fire-protection glass 10 is moved freely and deformed in a fire, the first portion 111 corresponding to the end portion of the fire-protection glass 10 and the second portions 112 corresponding to both the side surfaces of the fire-protection glass 10 are sufficiently spaced from the fire-protection glass 10 to prevent the fire-protection glass 10 from being broken.

In this embodiment, the elastic member 110 may be formed by bending a metal plate with elasticity, and particularly, the metal plate is preferably formed of spring steel.

Figure 4:
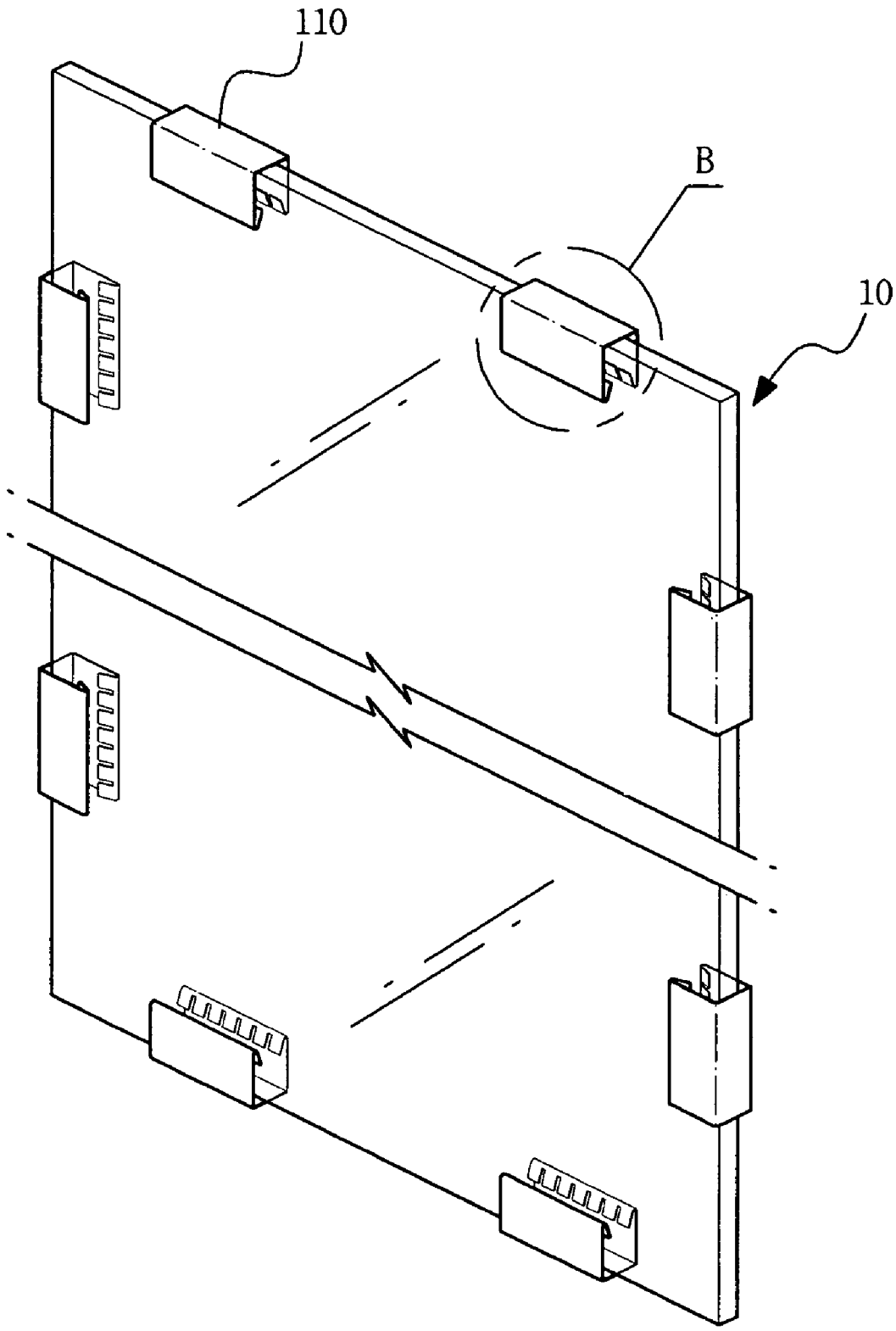
FIG. 4 is an enlarged perspective view showing a coupling state of a fire-protection glass and an elastic member constituting a fireproof door according to the embodiment of the present invention.

FIG. 4 is an enlarged perspective view showing a coupling state of a fire-protection glass and an elastic member constituting a fireproof door according to one embodiment of the present invention.

As shown in FIG. 4, the elastic member 110 may consists of a plurality of unit elastic pieces (hereinafter, the numeral reference 110 indicates the unit elastic piece), each of which is in contact with the edge portion of the fire-protection glass 10. Also, the unit elastic pieces 110 are spaced apart from each other at certain intervals.

In a case where the single elastic member 110 is in contact with the entire edge portion of the fire-protection glass 10, it is difficult to form a sufficient gap between the elastic member 110 and the fire-protection glass 10 when the fire-protection glass 10 is moved freely in the opening of the support means 100 at the time of the fire, and so the fire-protection glass 10 may be broken.

In addition, since heat is rapidly transferred due to the material of the elastic member, the internal temperature of the support means 100 and the surface temperature of the fire-protection glass 10 are rapidly increased. Thus, it is difficult to expect that the elastic member 110 prevents a separation of the fire-protection glass 10 from the support means 100. On the contrary, if a plurality of the unit elastic pieces 110 are spaced apart from each other at large intervals and are in contact with the fire-protection glass 10, the fire-protection glass 10 is moved freely at the time of fire, and so the fire-protection glass 10 is separated from the unit elastic pieces 110.

FIG. 5 is an enlarged perspective view of "B" portion in FIG. 4 and illustrates the elastic member constituting the fireproof door according to one embodiment of the present invention.

As shown in FIG. 5, the elastic member 110 (or the unit elastic piece) is preferably configured such that a plurality of slits 115 are formed in the bent third portion 113.

In this embodiment, due to the plurality of slits 115 as described above, the bent third portion 113 of the elastic member 110 is divided into a plurality parts. As a result, although a part of the bent third portion 113 is deformed by the movement of the fire-protection glass 10 and does not grip the fire-protection glass 10, the remained parts of the bent third portion 113 may grip the fire-protection glass 10.

In addition, it is preferable that an expansible flame retardant 153 is provided between the fire-protection glass 10 and the first portion 111 of the elastic member 110. Preferably, one surface of the expansible flame retardant 153 is fixed to the first portion 111 of the elastic member 110.

The reinforcing frame 120 constituting the supporting means 100 may be coupled to the elastic member 110 along an outer periphery of the elastic member. In a case where the fire-protection glass 10 is moved freely within support means 100 in a fire, the reinforcing frame 120 acting as a member capable of holding more securely the fire-protection glass 10.

In this embodiment, the reinforcing frame 120 may be formed by bending a metal plate with elasticity. In particular, the metal plate is preferably a zinc-coated steel plate.

In particular, the reinforcing frame 120 is preferably configured such that the elastic member 110 may be mechanically fitted thereto.

The support 300 may be made of retardant plywood that is generally filled in a wooden fireproof door. In particular, it is preferable that the support 300 is made of a calcium silicate board.

As the fireproof door in this embodiment, the support 300 can be separated from an indoor wall of a building. However, the present invention is not limited thereto. In a case where the support 300 is fixed to a wall corresponding to an exterior, the support may be used as a fireproof window frame, and this modification will be included within the scope of the present invention.

Meanwhile, an end portion of the fixing plate 140 may be bent toward the fire-protection glass 10. By bending the end portion of the fixing plate, it is possible to prevent the reinforcing frame 120 and the elastic member 110 supporting the fireproof glass 10 from being deviated in a fire.

In addition, at least one expansible fire-protective members (flame retardant) 154 and 155 are preferably attached to inner surfaces of the bent portions of the fixing plates The expansible flame retardant 154 and 155 are expanded in a fire to prevent the elastic member 110 and the reinforcing frame 120 from being separated from the fire-protection glass 10. Also, the flame retardant 154 and 155 prevent heat possessed in the fire-protection glass 10 placed out of the support means from being transferred into the support means 100, thereby lowering the temperature of a surface the fireproof door, which is opposite to a surface corresponding an area in which a fire is occurred.

The fireproof door 500 according to this embodiment may further comprise a nonflammable tape 130 disposed between the reinforcing frame 120 and the fixing plate 140.

The nonflammable tape 130 is not burned easily. Preferably, the nonflammable tape 130 has elasticity and is disposed between the reinforcing frame 120 and the fixing plate 140.

In this embodiment, since the elastic member 110, the reinforcing frame 120 and the fixing plates 140 are made of steel with high thermal conductivity, the nonflammable tape 130 restrains heat from being transferred, and so the temperature of a surface the fireproof door, which is opposite to a surface corresponding an area in which a fire is occurred, is lowered.

In this embodiment, the nonflammable tape 130 is preferably made of a ceramic material.

Preferably, the fireproof door 500 according to this embodiment may further include expansible flame retardant 151 and 152, which are received in spaces defined between the reinforcing frame 120 and the support 300. Each of the expansible flame retardant is attached to at least one of the fixing plate 140 and the reinforcing frame 120.

In this embodiment, each of the expansible flame retardant 151, 152, 153, 154, and 155 is preferably made of graphite ("expansible graphite"). The expansible graphite causes water and oxidized compounds contained therein to generate gas by heat, and as a result, a scale-shaped graphite is expanded to form a stable layer against heat or chemicals, thereby exhibiting flame retardant effects.

In particular, the expansible graphite forming the expansible flame retardant of this embodiment is a flame retardant material free from halogen and is environment-friendly since an incendiary property may be controlled to a low level. This graphite prevents or delays the collapse of the fireproof door caused by flame generated at the time of the fire.

The expansible flame retardant is expanded in a fire to intercept fire propagation, delays heat transfer together with the nonflammable tape to lower the temperature of a surface the fireproof door, which is opposite to a surface corresponding an area in which a fire is occurred, and so the fireproof door is not easily burnt.

In the fireproof door 500 according to this embodiment, flame retardant woods 200 are attached to the periphery of the fixing plates 140. The flame retardant woods 200 harmonizes the fireproof door with the interior designs and improves retardant performance.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and appended claims. In addition to variations and modifications in the component parts and/or arrangements, alternative uses will also be apparent to those skilled in the art.

What is claimed is:

1. A fireproof door, comprising:

a support having an opening formed thereon;

a fire-protection glass placed in the opening of the support supported by the support; and a support means fixed to the support for supporting the fire-protection glass, the support means comprising an elastic member in contact with both surfaces of an edge portion of the fire-protection glass; fixing plates being fixed to the support and being in contact with both side surfaces of the elastic member through inner surfaces thereof to support the elastic member to the support; and a reinforcing frame provided between the fixing plate and the elastic member;

wherein the elastic member is composed of a first portion corresponding to a terminal end of the fire-protection glass, second portions extending from both ends of the first portion and corresponding to both sides of the fire-protection glass; respectively, and bent third portions respectively bent from ends of the second portions toward the fire-protection glass; whereby the end portion of the fire-protection glass is placed between the second portions of the elastic member and ends of the third portions of the elastic member are in contact with both side surfaces of the fire-protection glass;

wherein the elastic member has a plurality of slits in the bent third portion.

2. The fireproof door as claimed in claim 1, wherein the elastic member is divided into a plurality of unit elastic pieces, the unit elastic pieces are spaced from each other.

3. The fireproof door as claimed in claim 1, further comprising a nonflammable tape disposed between the reinforcing frame and the fixing plate.

4. The fireproof door as claimed in claim 1, further comprising a flame retardant wood attached to periphery of the fixing plate.

5. The fireproof door as claimed in claim 1, wherein the fixing plate is in contact with the fire-protection glass through an end portion bent thereof toward the fire-protection glass.

6. The fireproof door as claimed in claim 5, further comprising an expansible flame retardant attached to a surface of the bent portion of the fixing plate.

7. The fireproof door as claimed in claim 1, further comprising an expansible flame retardant received in a space formed between the reinforcing frame and the support, and fixed to at least one of the fixing plate and the reinforcing frame through one surface thereof.

* * * * *

UNITED STATES PATENT AND TRADEMARK OFFICE

CERTIFICATE OF CORRECTION

PATENT NO. : 8,042,316 B2
APPLICATION NO. : 12/321131
DATED : October 25, 2011
INVENTOR(S) : Won-Ho Lee, Sang-Ho Shin and Seong-Hoon Yue It is certified that error appears in the above-identified patent and that said Letters Patent is hereby corrected as shown below:

Column 6, line 22, "portion" should read --portions--.
Column 6, line 30, "attached to periphery" should read --attached to a periphery--.

Signed and Sealed this
Nineteenth Day of March, 2013

Teresa Stanek Rea
*Acting Director of the United States Patent and Trademark Office*